United States Patent [19]

Giraudi et al.

[11] 4,043,011

[45] Aug. 23, 1977

[54] PACKAGING MACHINES

[75] Inventors: Giorgio Aldo Maria Giraudi; Nino Imperiale, both of Milan, Italy

[73] Assignee: W. R. Grace & Co., Duncan, S.C.

[21] Appl. No.: 699,023

[22] Filed: June 23, 1976

[30] Foreign Application Priority Data

June 30, 1975 United Kingdom ..... 27562/75

[51] Int. Cl.[2] ..... B65B 51/05; B23P 11/00

[52] U.S. Cl. ..... 29/33.5; 29/243.57; 53/138 A

[58] Field of Search ..... 29/33.5, 243.57, 243.56, 29/243.5; 53/138 R, 138 A

[56] References Cited

U.S. PATENT DOCUMENTS

| | | | |
|---|---|---|---|
| 3,293,736 | 12/1966 | Tipper | 29/243.57 |
| 3,383,746 | 5/1968 | Narduzzi et al. | 29/35.5 |
| 3,526,944 | 9/1970 | Cherup | 29/243.57 X |
| 3,717,972 | 2/1973 | Niedecker | 53/138 A |
| 3,818,574 | 6/1974 | Reid et al. | 29/243.57 |
| 4,001,926 | 1/1977 | Velarde | 29/243.56 |

*Primary Examiner*—Othell M. Simpson
*Assistant Examiner*—Z. R. Bilinsky
*Attorney, Agent, or Firm*—John J. Toney; William D. Lee, Jr.; John B. Hardaway

[57] ABSTRACT

The invention relates to an "in-chamber" gathering and clipping unit in which the gathering members are rotatable around a common hub and the clip drive punch is driven to advance clips individually from a location coaxially within the hub along a direction radially outwardly onto a bag neck gathered by the gathering members. The radius of the gathering members can be kept short and have their arcuate gathering surfaces so designed that the gathering action takes place within a 90° movement of each of the gathering members, so each gathering member retracts below the hub and still leaves the gathering head narrow in width so it can be incorporated in any one of a wide range of existing vacuum chamber packaging machines.

12 Claims, 26 Drawing Figures

PACKAGING MACHINES

The present invention relates to vacuum packaging apparatus, and in particular to a machine for closing a product-containing bag using a U-shaped deformable metal clip which is driven towards the gathered neck of the bag to close the bag by deformation of the clip legs.

It is known to provide a vacuum chamber packaging apparatus where the chamber opens to receive a loaded bag which enters the chamber with its neck completely ungathered, and then during or after closing of the chamber the bag neck becomes gathered and correctly positioned for clipping.

Such an apparatus is illustrated in our British Pat. Nos. 1,353,157 which issued in Oct. 28, 1971 and 1,361,142 which issued on Jan. 2, 1973 in which partial gathering of the bag neck is achieved during closing of the chamber, by the action of a rib in the chamber cover which confines the bag neck into an elongate horizontal slot so that final gathering can be achieved by movement of two gathering studs towards one another along a gathering path which, in U.S. Pat. No. 1,353,157 is a rectlinear path, and in U.S. Pat. No. 1,361,142 is a long radius arcuate path defined by two gathering arms which are pivoted about spaced axes disposed well below the clipping station.

In each of these forms of apparatus the gathering members (i.e. the studs or the gathering tips of the gathering arms) start from positions generally level with the clipping station but symmetrically horizontally spaced therefrom and sweep inwards in a generally horizontal direction. Thus the gathering members always protrude above a horizontal plane tangent to the bottom of the cross-section of the gathered bag neck and this requires careful design of the vacuum chamber to accommodate the gathering members at the extremities of their separating movement.

In accordance with the present invention we provide a gathering and clipping head for a vacuum chamber type of packaging apparatus, comprising opposed gathering members rotatable about a common hub and provided with arcuate gathering surfaces which are convex towards said common hub and overlap in the closed configuration of the gathering members to gather together the neck of a bag to define a tightly gathered neck configuration for clipping, means for guiding a supply of clips to the centre of said hub, and means for driving individual clips radially outwardly from the said centre of the hub to be deformed around a bag neck gathered by said gathering members.

With such an arrangement the radius of action of the gathering portions of the gathering members is much shorter than is conventional and the angle of sweep of each gathering member is increased such that the two gathering members may be much shorter than hitherto and may also readily retract to positions below the clipping level without involving an increase in the width of the clipping and gathering head. This enables a standard form of clipping and gathering head to be incorporated in widely differing designs of vacuum chamber.

Preferably, the gathering members between them define the clip guide slot, the clip-leg deforming die is carried by one of the gathering members; and the means for driving the clips radially outwardly comprise a clipping punch actuable to move radially of the hub and along the clipping slot defined by the gathering members when said gathering members are in their closed positions.

Thus, the whole gathering and clipping function of the apparatus can be incorporated in a single clipping head whc consists of the opposed gathering members on their common hub, the clipping die carried by one of the gathering members, the clipping slot defined between the opposed gathering members in their closed positions, and the clip punch for driving the clips radially outwardly through the hub and into the clipping slot. This is in contrast to the arrangement in our said British Pat. Nos. 1,353,157 and 1,361,142 where the clipping die was carried by the cover of the vacuum chamber.

Conveniently, the hub is hollow at its centre for guiding the supply of clips along axially within the hub to the location from which they are to be driven diametrically of the hub onto the gathered bag neck by means of the clipping punch.

This arrangement has several advantages, for example the facts that (a) there is no longer any need for careful register between the gathering members and a clipping die carried by the chamber cover, (b) adjustment of the clipping head geometry is much more straight-forward since all the components are carried from a common hub rather than being arranged to move in various different directions and carried by various different parts of the chamber, and (c) maintenance can be facilitated since each machine may be provided with a spare clipping head so that any need for maintenance of the existing clipping head in the machine can be met by removing the head requiring maintenance and replacing it by the other head which will operate quite satisfactorily while the maintenance is being carried out.

In this clipping head, the curvature of the gathering surfaces of the gathering members can be chosen to enable an effective gathering action to be achieved using members of relatively short radial extent so that, in the closed condition of the gathering members, the clipping die is a relatively short radial distance from the axis of rotation of the gathering members and this provides a particularly compact and highly robust arrangement in which the clipping reaction force exerted on the die can be readily absorbed by the gathering members themselves without the need for any external reinforcement.

A further advantage of this particular arrangment is that by suitable design of the curved gathering faces of the gathering members it is possible for the members to carry out their gathering action during substantially 60° rotation of each member and this with only a relatively short radial dimension for the gathering members. Hence a further advantage is that by spacing the starting positions of the gathering members from their closed positions by substantially 90° it is possible for the two gathering members to be completely retracted below the plane of the bag feed conveyor so that there is no obstruction whatsoever to bag and product feed to the chamber and the gathering members need not commence their gathering action until the chamber has closed. This can be achieved with one standard head, regardless of the product width. Where a very wide product is to be handled, the clipping station may include yieldably 'knock down' gathering plates which can be folded flat to a horizontal configuration during loading and will then spring up to present an upwardly open gathering recess to receive and loosely confine the bag neck which is manually placed in the gathering recess.

During the final stages of the gathering action the clip punch engages an already aligned clip and supports it ready for final clipping action once the gathering members have arrived at their closed positions in which they are held during the clipping operation. The relatively short radial extent provided for by the highly advantageous construction of using a pair of gathering members rotating about a common hub from which the clips are individually driven ensures that the clip travel between the hub centre and the clipping die is only short and this simplifies the synchronising linkage which may be constructed so that the gathering members and the clipping punch are both driven from a common yoke.

Whereas in our said two British Pat. Nos. 1,353,157 and 1,361,142 it was necessary for the clipping die to be supported by the cover of the vacuum chamber, the arrangement of the present invention enables the clipping die to be supported by one of the gathering members and this avoids the need for careful registration between the gathering members and the chamber cover.

More suitably, a cutter is also rotatably mounted with respect to the common hub of the gathering members and driven so that, as the clipping punch begins to retract, before opening of the gathering members to release the clipped neck of the bag, the cutter rotates to sever the surplus bag material from the clipped neck.

In a particularly convenient embodiment of the invention the cutter, the clipping punch and the gathering members are driven from a common reciprocating drive member such that during retraction of the clipping punch the cutter rotates in a first direction to cut the gathered bag neck and subsequently rotates in the reverse directin of rotation to be returned to its starting position, retracted below the tangent plane to the bottom of the cross-section of a bag when gathered by the gathering members.

The invention also provides a clipper comprising a rotary magazine having a plurality of clip-receiving chambers disposed equiangularly around its axis of rotation; a common clip drive piston adapted to be driven along a fixed path for advancing through the clip chambers in succession to urge the clips in the chamber towards the clipping end of the chamber; and means responsive to depletion of the supply of clips in any one chamber for retracting the clip drive piston from the magazine and for automatically indexing the magazine to bring a fresh clip-receiving chamber into register with the path of the clip drive piston.

In order that the present invention may more readily be understood the following description is given, merely by way of example, reference being made to the accompanying drawings in which.

Figure 8A:
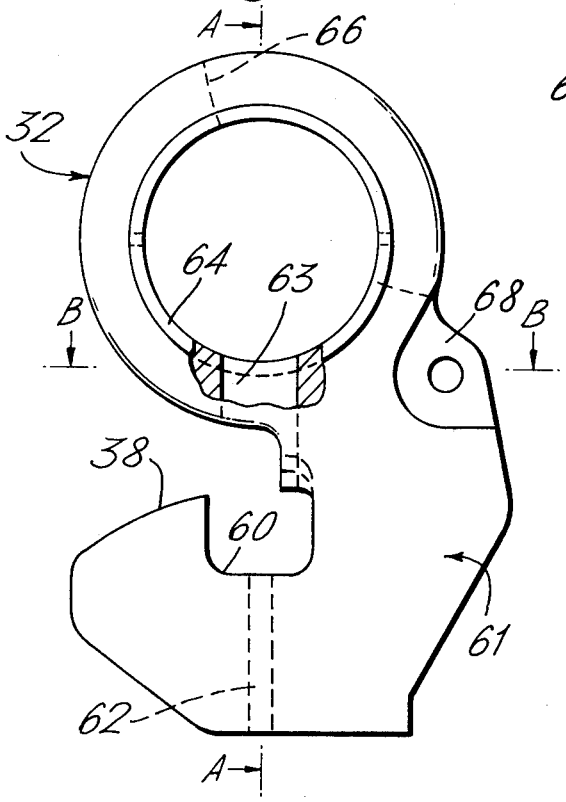
Figure 8C:
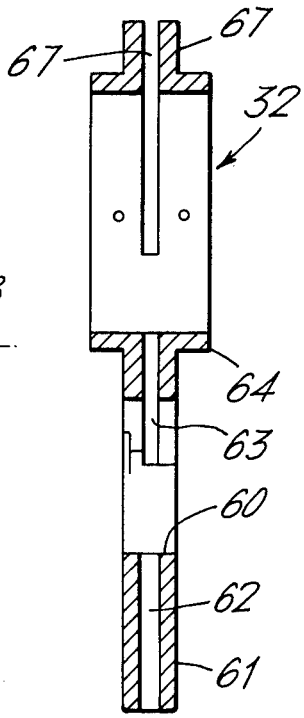
Figure 8B:
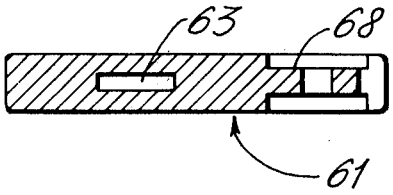
Figure 8D:
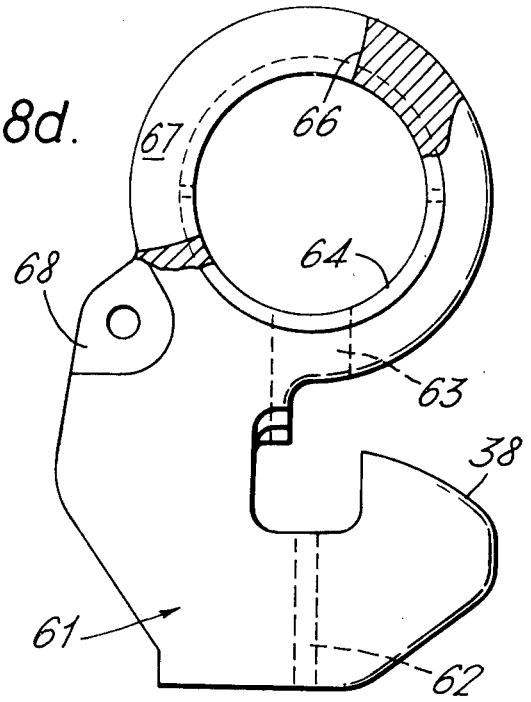
Figure 9A:
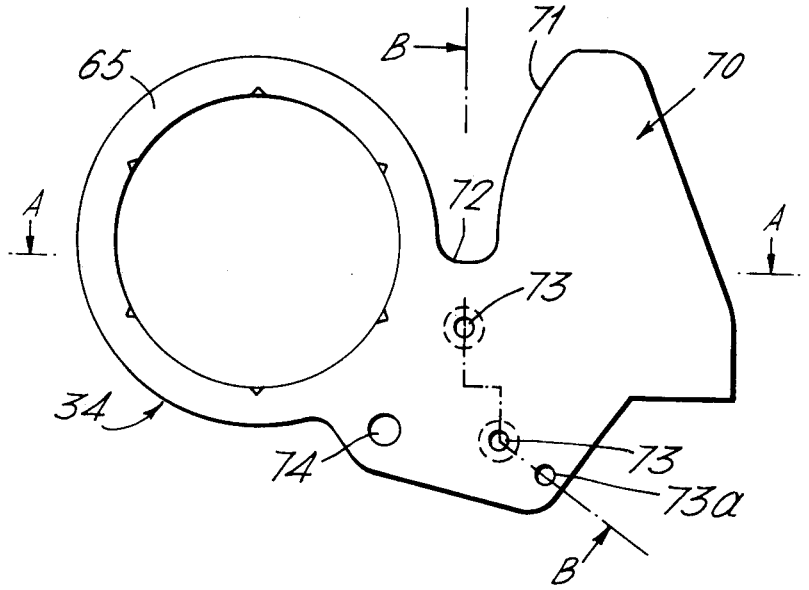
Figure 9B:
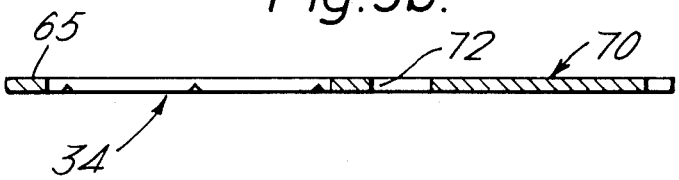
Figure 9C:
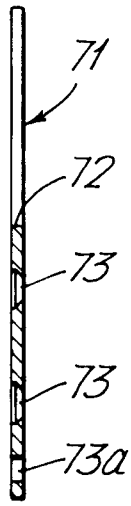

FIGS. 8*a* to 8*d* illustrate a front elevational, chordal section, diametral section and rear elevational view of one of the gathering members of the gathering and clipping head of FIGS. 2 to 7;

FIGS. 9*a* to 9*c* illustrate a front elevational diametral sectional, and chordal sectional view of a gathering member for movement in opposition to the gathering member of FIGS. 8*a* to 8*d;*

Figure 10A:
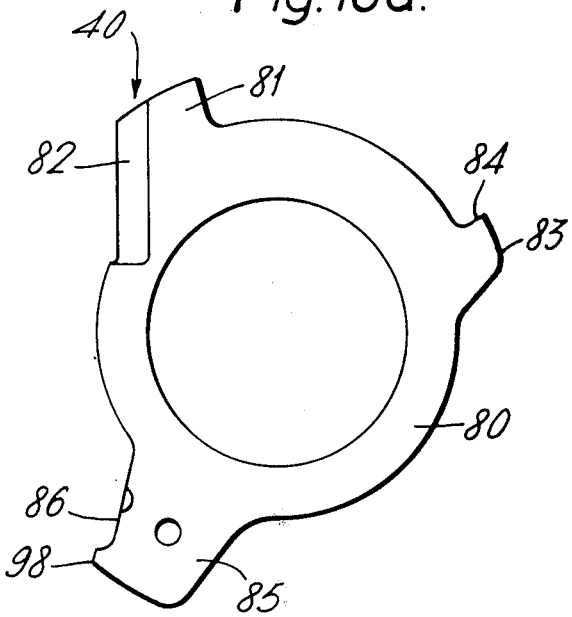
Figure 10B:
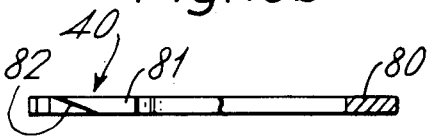

FIG. 10*a* is a front elevational view of the cutter for use with the gathering and clipping head of FIGS. 2 to 7;

FIG. 10*b* is a sectional view of the cutter of FIG. 10*a,*

Figure 4:
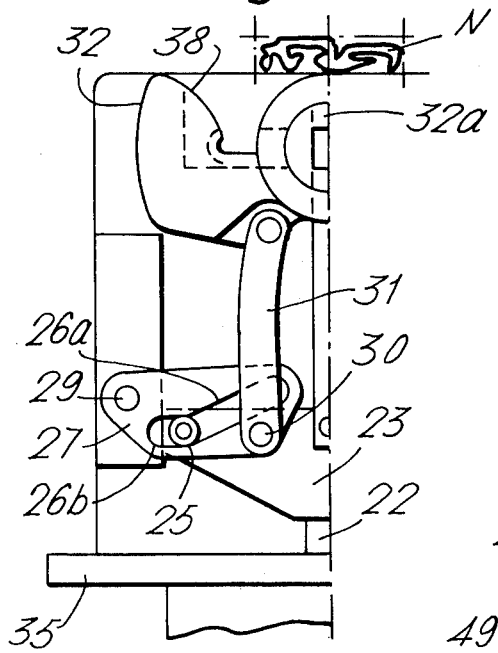
FIG. 4 is a view similar to FIG. 3 but showing the drive linkage to one of the gathering members in greater detail and illustrating the gathering member in open configuration.
Figure 11:
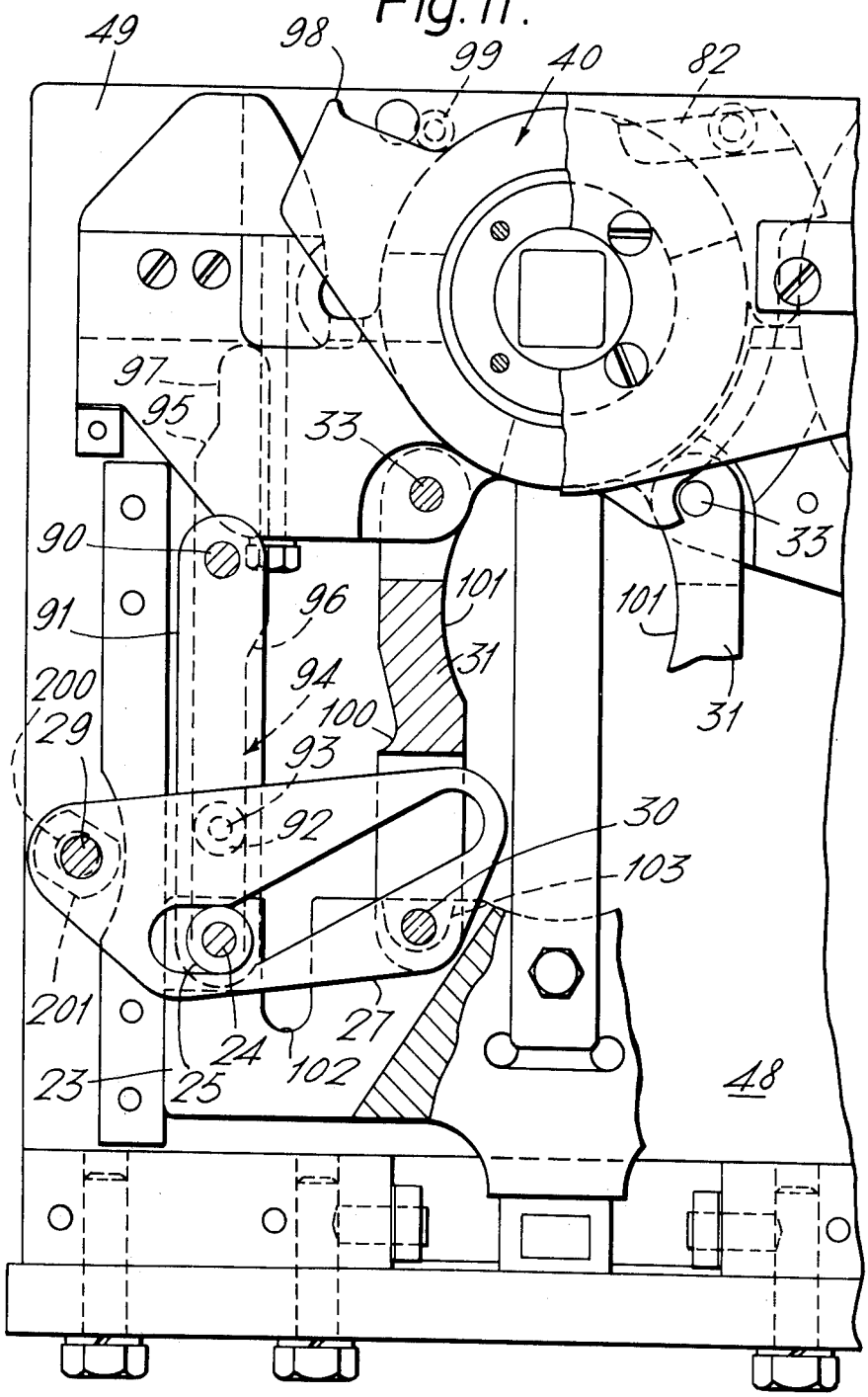

FIG. 11 is a view similar to FIG. 4 but showing in much greater detail the various components of the gathering and clipping members and illustrating a drive mechanism for the cutter of FIGS. 10*a* and 10*b;*

Figure 1:
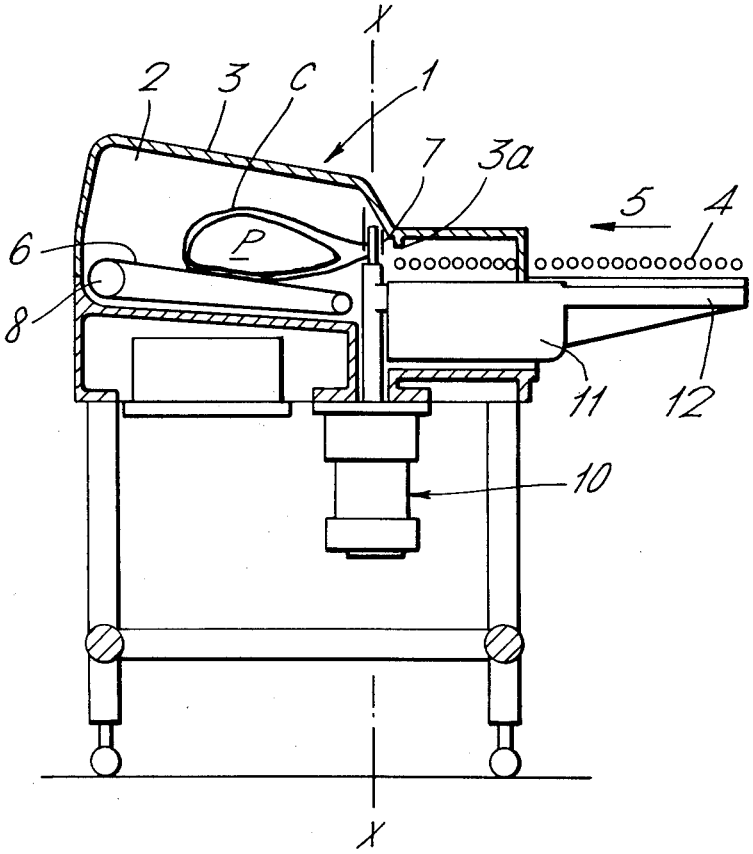
FIG. 1 is a side elevational, partly sectional and partly schematic view of a vacuum packaging apparatus in which the gathering and clipping head of the present invention is incorporated.
Figure 12A:
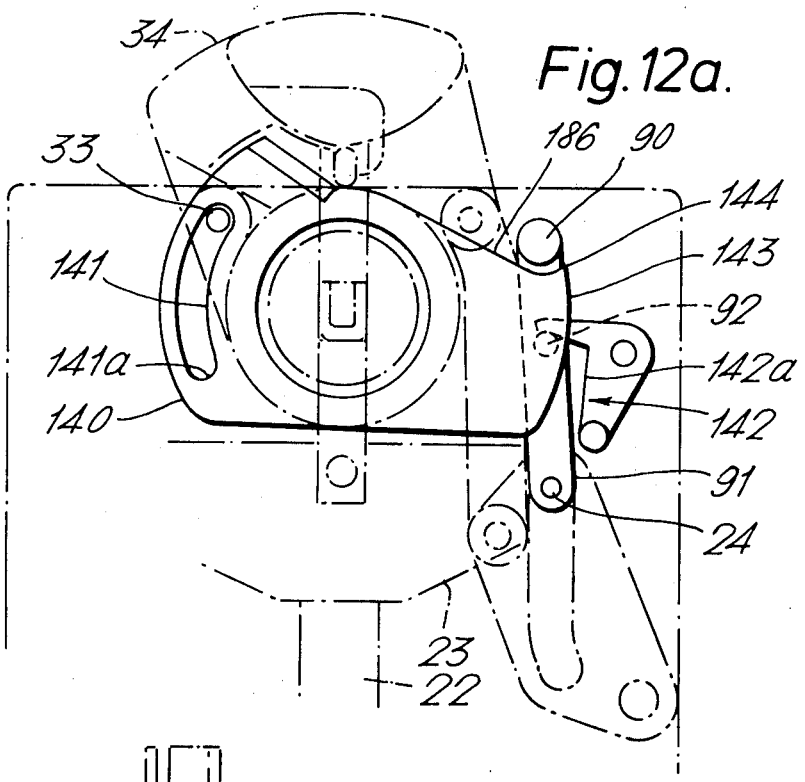
Figure 12B:
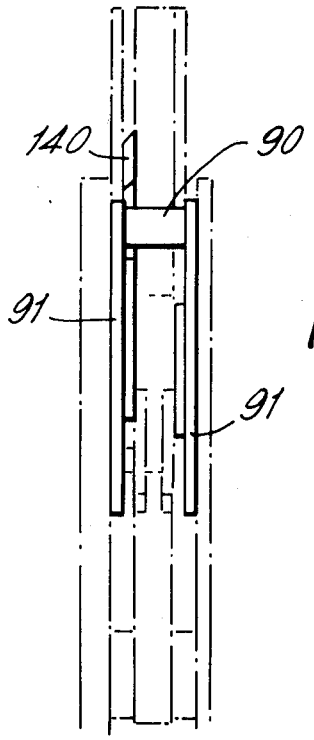
Figure 13:
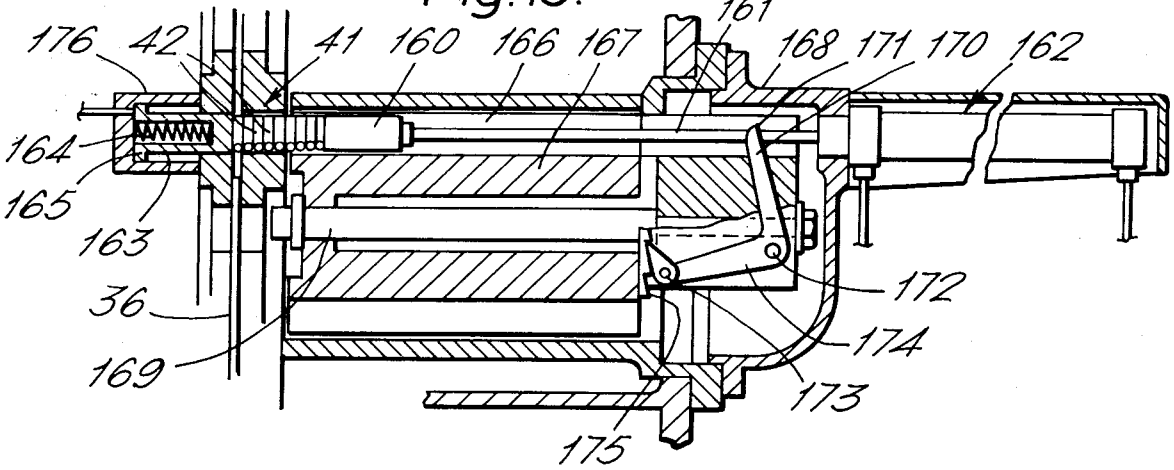
Figure 14:
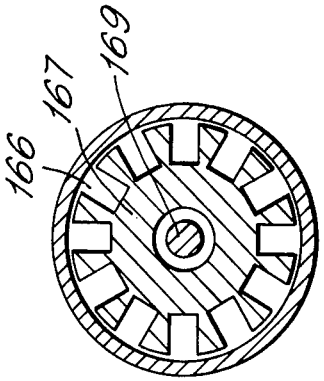
Figure 15B:
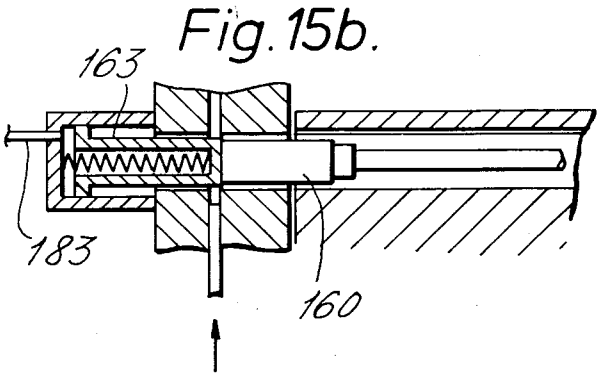
Figure 15A:
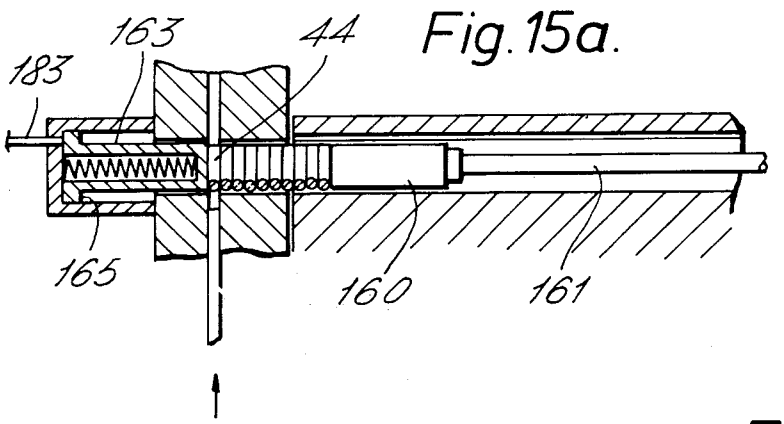
Figure 15C:
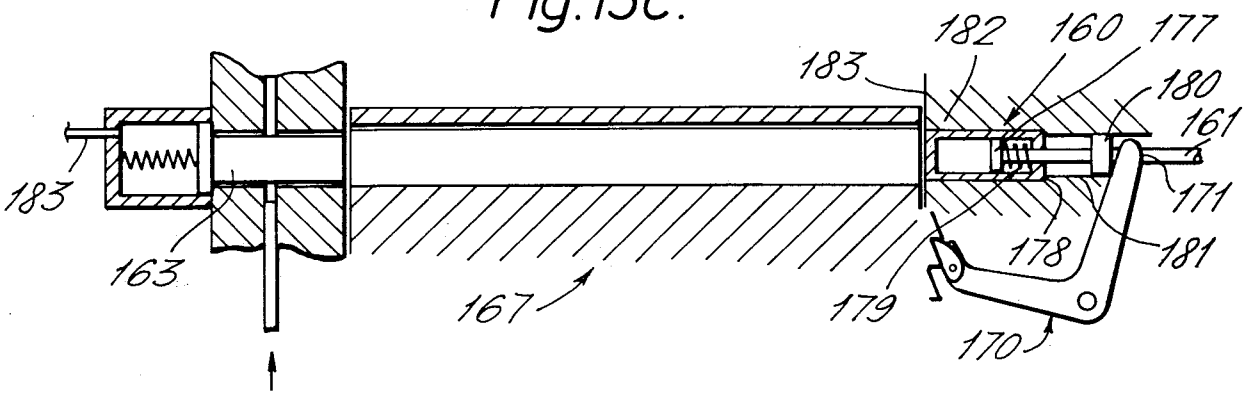
Figure 16:
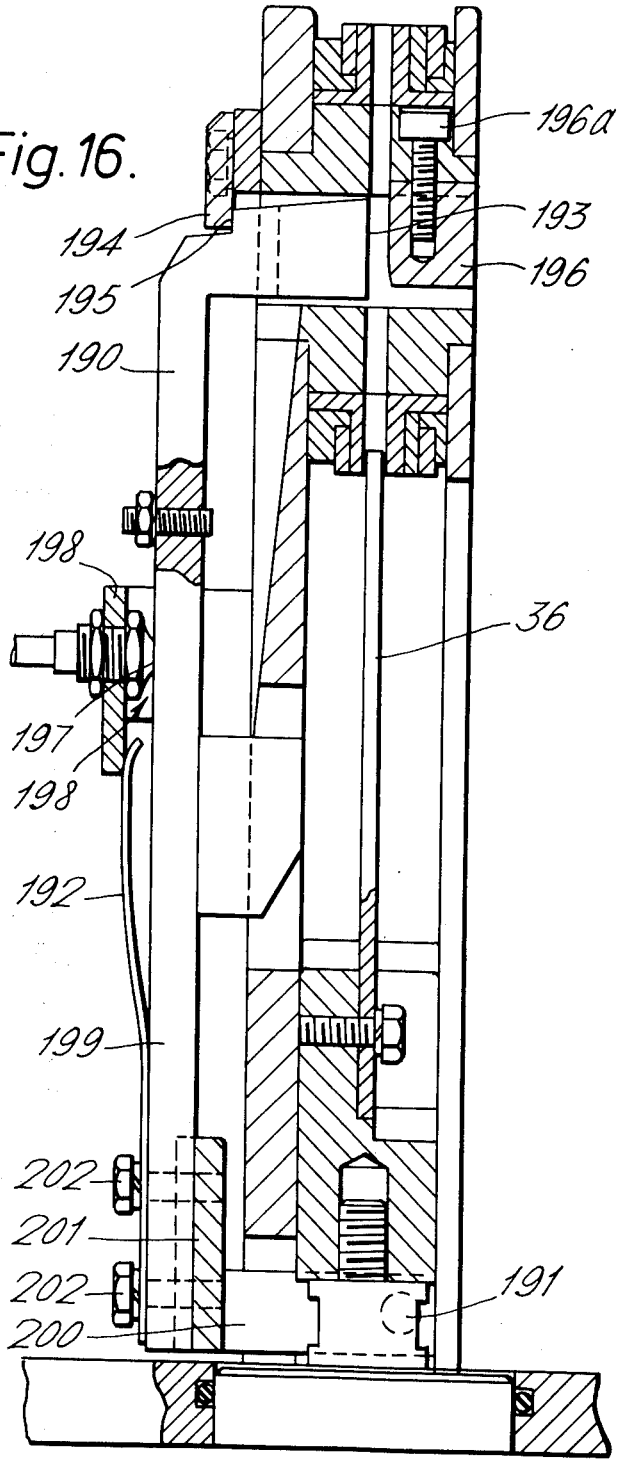
Figure 17:
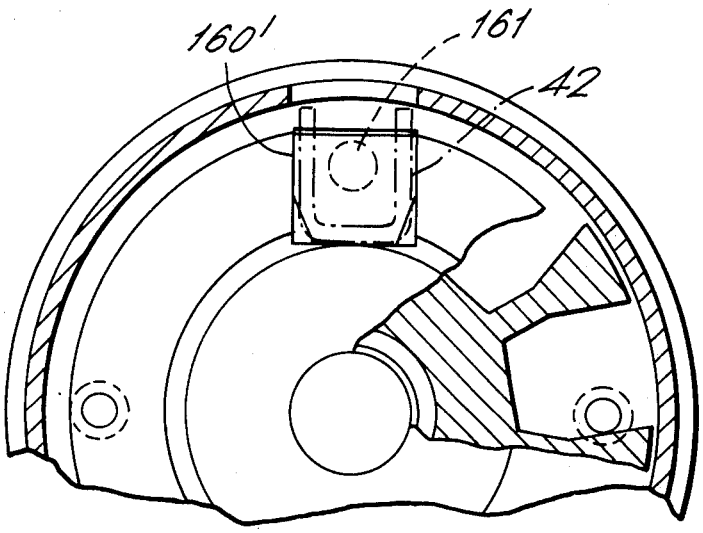

FIGS. 12*a* and 12*b* are rear elevational and side elevational, both partly schematic, views of an alternative embodiment of cutter for use with the gathering and clipping head of FIGS. 2 to 7;

FIG. 13 is a vertical sectional view through the clip magazine and drive unit of the apparatus of FIG. 1;

FIG. 14 is a transverse sectional view through the clip magazine illustrated in FIG. 13;

FIG. 15*a* is a detail of the clip drive and feeding mechanism of FIG. 13 showing operation while a supply of clips is present;

FIG. 15*b* is a view similar to FIG. 15*a* but showing the condition at depletion of a supply of clips;

FIG. 15*c* is a view similar to FIGS. 15*a* and 15*b* but showing the arrangement when the clip drive piston has been retracted prior to indexing of the clip magazine to feed a fresh line of adhesive-supported clips;

FIG. 16 shows a side elevational, partly sectional, view of an alternative form of clip reaction member at the clipping station; and FIG. 17 shows a cross-section through a clip-receiving chamber of an alternative embodiment of clip magazine.

Referring now to FIG. 1, there is shown a vacuum packaging apparatus 1 comprising a vacuum chamber 2 enclosed by a divider cover 3 which is raised and lowered by pivotal movement about a horizontal axis to admit one or more loaded bag which will be fed in the direction of the arrow 5 with the mouth of each bag at the trailing end along a roller conveyor 4 which may be driven rollers for automtic loading or idler rollers for manual chamber loading. The partition 3*a* in the cover divides the chamber into two separately evacuatable chamber portions as claimed in our copending British British Patent Application No. 1334/70.

Once the bagged product has passed a sensor (not shown) at or adjacent the clipping plane X—X its forward movement stops and it now falls onto a conveyor 6 which supports the weight of the product within the bag throughout the gathering and clipping operation.

FIG. 1 shows the clipping and gathering arms 7 closing together to gather the neck of the bag C for clipping. In FIG. 1 the bag C is shown as loosely held around the product P, merely for ease of illustration. In fact at this particular stage in the operating cycle of the divided vacuum chamber the bag will be under a positive pressure causing the bag material to cling tightly to the contour of the product P.

The conveyor 6 is, in this particular apparatus, in the form of a belt conveyor which is pivotable about the roller 8 at the downstream end so as to allow the roller 9 at the upstream end to be adjusted for ensuring that in the clipping position the neck of the loaded bag resting on the conveyor 6 will be arranged such that the gathering and clipping members 7 are disposed at approximately the median height of the product in the bag.

After gathering and clipping, possibly also with severing of the excess bag material from the clipped bag neck, the chamber cover 3 is raised and the conveyor 6 advanced to discharge the product from the vacuum chamber.

The present invention is concerned with the gathering and clipping head illustrated only schematically at 10 in FIG. 1, and the invention also provides an improvement in the clip magazine 11 and clip drive unit 12.

Figure 2:
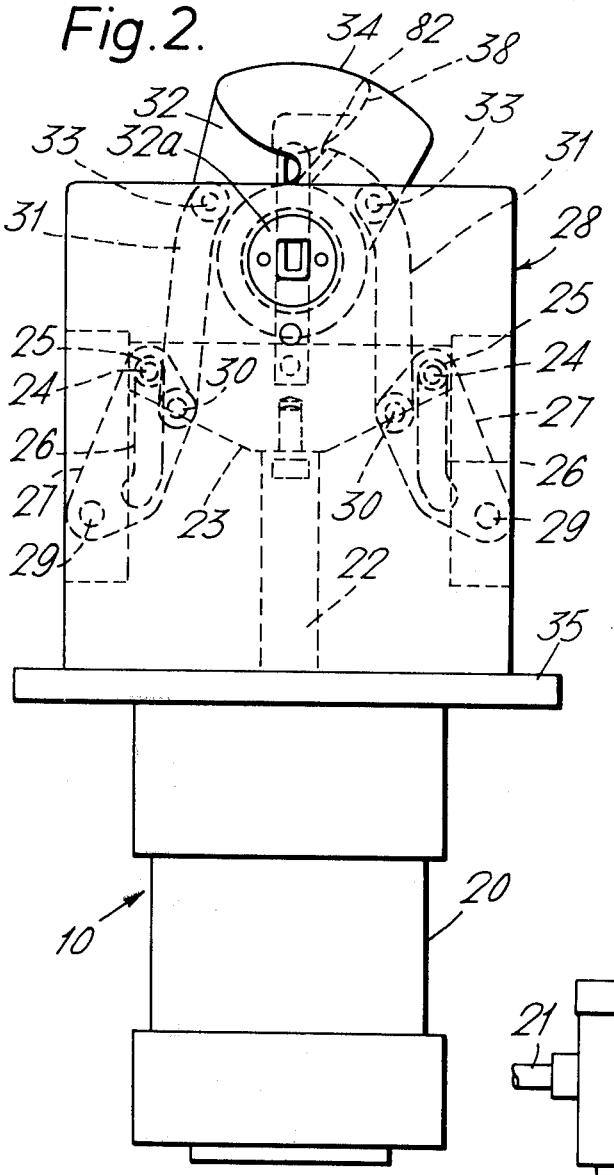
FIG. 2 is a front elevational view of the clipping head alone.
Figure 3:
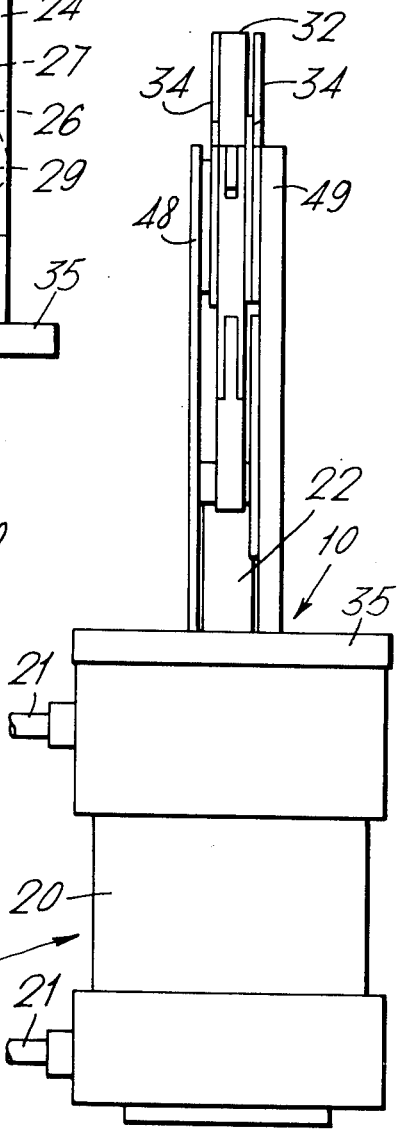
FIG. 3 is a side elevational view of the clipping head of FIG. 2.

FIG. 2 shows a front elevational view of the clipping head 10 of FIG. 1, and FIG. 3 shows a side elevational view of the same clipping head.

The clipping head 10 shown in FIGS. 1 and 2 includes a cylindrical jack housing 20 having air inlet and outlet conduits 21 which serve to drive the jack piston (not shown) for reciprocating the piston rod 22 secured to a yoke 23.

Figure 6:
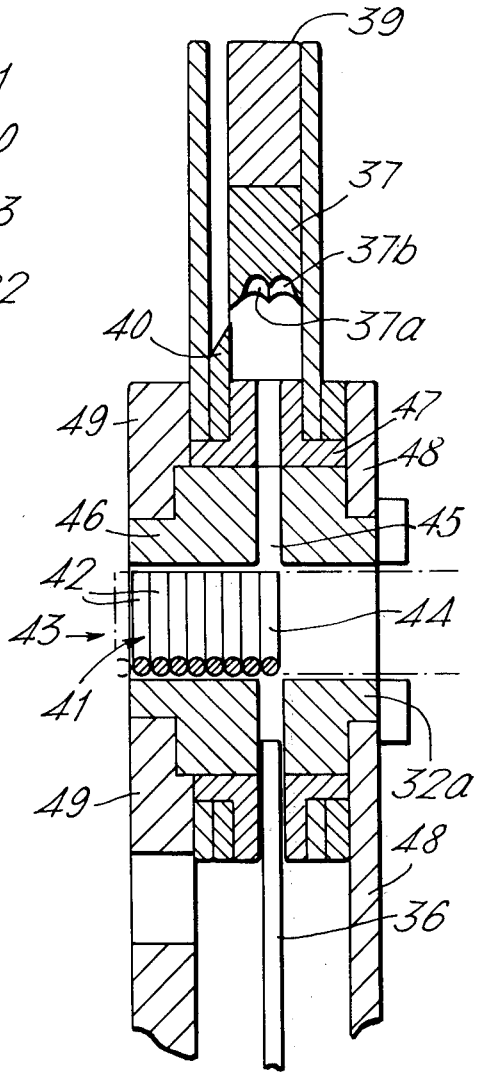
FIG. 6 is a vertical sectional view taken through the hub of the gathering and clipping head of FIGS. 2 to 5.

At each side, the yoke 23 has two upstanding studs 24 rotatably supporting follower rollers 25 which move along cam slots 26 formed in respective pivotable drive link plates 27. These drive link plates 27 are themselves articulated to the frame 28 of the clipping head by pivot pins 29 and are also pivotally connected at 30 to respective drive struts 31, one of which is pivotally connected to a lefthand gathering arm 32 at pivot arm 33, and the other of which is pivotally connected at a pivot pin 33 to a righthand gathering member comprising a pair of gathering plates 34 (FIGS. 3, 6 and 9). It will be appreciated that the gathering members 32 and 34 are the same as those illustrated schematically at 7 in the side view of FIG. 1.

Figure 5:
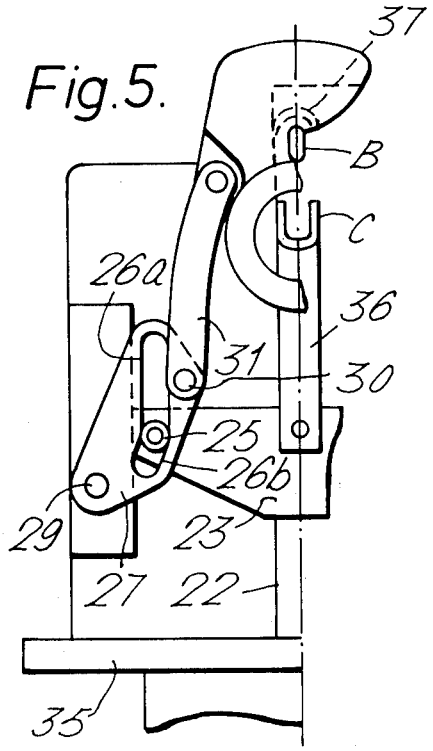
FIG. 5 is a view similar to FIG. 4 but showing the gathering member in closed configuration.

The drive connection to the lefthand gathering member 32 can best be understood by referring to FIGS. 4 and 5 where FIG. 4 shows the gathering member 32 in retracted configuration and FIG. 5 shows the same view when the yoke 23 has advanced far enough to close the gathering member 32 into its gathering and clipping position but when the clipping punch 36 has just contacted the clip C but before the clipping punch has driven the clip onto the bag and the clipping die 37 carried by the lefthand gathering member 32.

FIG. 4 shows that in the retracted position of the yoke 23 the drive link plate 27 is in its extreme clockwise position such that the roller 25 is near the junction point between a first rectilinear run **26*a* of the slot 26 and a second rectilinear run 26*b* of the same slot. In this position the drive strut 31 pivotally connected between the lefthand drive link plate 27 and the lefthand gathering member 32 lies substantially parallel to the clipping punch 36. The semi-gathered neck of the bag can be seen at N in FIG. 4**.

As the yoke 23 moves forward under driving action from the piston rod 22 the roller 25 initially moves into the second rectilinear run **26*b* of slot 26 to arrive at the end nearest the pivot pin 29 of drive link plate 27 when the roller 25 has risen so that its axis is at the same level as the axis of pin 29. Further advance of the yoke 23 beyond this position causes the roller 25 to move away from the pivot pin 29 until it once again arrives at the junction point between the two rectilinear runs 26*a* and 26*b* of the slot 26. It is this configuration which is shown in FIG. 5**.

Throughout the initial part of this upward movement of the yoke 23, the clipping punch 36 has risen towards the clip C but only just makes contact with the clip C at around the time when the roller 25 arrives back at the beginning of the rectilinear run **26*a* of the slot 26**.

As will be seen from FIG. 5, this first part of the upward movement of the yoke 23 has caused the lefthand drive link plate 27 to pivot in the anticlockwise direction through an angle of approximately 60° and, in so doing, the pivot pin 30 with drive strut 31 has risen to drive the strut 31 upwardly for rotating the lefthand gathering member 32 through 90°. During this movement of the lefthand gathering member 32, its arcuate leading or gathering face 38 will have moved upwardly and rightwardly to strike the lefthand end of the partially gathered neck N of the bag, and thereafter further closing movement of the lefthand gathering member 32 towards the righthand gathering member 34 (FIG. 2) will cause gathering of the neck into a tightly bunched configuration as shown at B in FIG. 5. This bunching action is carried out by virtue of the presence of both of the two gathering members which provides opposed circumferential gathering movements and simultaneously a radially inward gathering movement in unison towards the axis of rotation of the gathering members 32 and 34.

Once the two gathering members 32 and 34 have arrived in their closed configuration (the configuration illustrated in FIG. 2) the yoke 23 is free to advance further without disturbing the gathering members 32 and 34 since the rectilinear run **26*a* of the slot 26 of the lefthand drive link plate (and also the corresponding run of the slot of the righthand drive link plate) will lie parallel to the axis of the piston rod 22 so that as the yoke 23 rises further the roller 25 is free to move up the rectilinear run 26*a* without disturbing the position of the drive link plate 27 and consequently without any further movement of the gathering members 32 and 34**.

During this further raising of the yoke 23 the clipping punch 36 drives the clip C upwardly along a clipping guide which extends radially through the hub of the gathering member 32 and is then in part formed by the clipping die 37 on the lefthand gathering member 32 and in part also formed by a corresponding portion of the righthand gathering member 34 to be described later.

The fact that the two gathering members 32 and 34 are both mounted for rotation about a common hub **32*a* and between them define both the clip guide and the clipping die leads to a particularly compact form of clipper which can readily be installed in, or removed from, the apparatus 1 with the minimum of inconvenience to other components of the apparatus. Clearly, the self-contained clipping head 10 of FIG. 2 contains all the elements necessary for the clipping, namely the drive jack within the housing 20, the gathering members 32 and 34, the clipping punch 36, and the clipping die 37**.

In order to ensure symmetry of the gathering action there are, as mentioned above, two righthand gathering plates 34 forming the righthand gathering member and a single lefthand gathering member 32 which interengages between them. Thus, there will be little or no tendency for the bag neck to become jammed between the engaging faces of the various lefthand and righthand gathering members since the two righthand gathering plates will urge the bag neck leftwardly but by contact with it at parallel planes which are spaced apart and when the opposite gathering member 32 interengages with these two plates 34 it urges the bag rightwardly between the two planes of contact of the gathering plates 34.

This arrangement is particularly clearly illustrated in FIG. 6 which shows a vertical sectional view taken on a plane parallel to the axis of rotation of the gathering members 32 and 34. In this Figure there is additionally illustrated a rotary cutter 40 which serves to sever the excess bag material from the clipped bag neck as will be described later.

A clip magazine (to be described later with reference to FIGS. 13 to 15) feeds a strip 41 of clips 42 along the direction of arrow 43 (FIG. 6) towards the position of the end clip 44 which is about to be engaged by the clipping punch 36.

It will be appreciated that the view of FIG. 6 is shown from the opposite side of the clipping head from the view shown in FIG. 1 so that the clips 42 are in this direction being fed from the left whereas clips in the FIG. 1 illustration will have been fed from the right. This means that the cutter 40 is to the inlet side of the clipping plane, i.e. that side at which the surplus bag material will remain when the product has been correctly positioned on the support conveyor 6.

As the punch 36 rises, it will carry the end clip 44 upwardly into the slot 45 extending through both the inner shaft 46 and an outer bearing 47 of the hub 32*a* of the gathering members so that when the clip 44 emerges from the slot 45 one of the limbs of the clip will engage in the lefthand groove 37*a* of the clipping die 37 and the other leg will engage in the righthand groove 37*b* causing the two legs to ride around the arcuate grooves 37*a* and 37*b* side-by-side to wrap tightly around the gathered neck N of the bag parallel to one another, rather than having impact between the tips of the legs at the beginning of the clipping action with the possibility of fouling of the clip and inadequate closure of the bag. This "side-by-side" deformation of the clip legs is well known in the art and requires no further explanation.

The inner shaft 46 of the gathering hub 32*a* is rotatably supported by front support plate 48 and rear support plate 49 which together form the frame 28 of the clipping head 10. These same support plates 48 and 49 also serve to hold the pivot pins 29 of the drive links 27 of FIGS. 4 and 5 and are secured to a cross member 35 forming an end plate of the jack housing 20 (FIGS. 2 and 3).

The sectional view of FIG. 6 shows the gathering and clipping members while in their closed or "clipping" position and serves to illustrate the relative spacing of the various gathering and clipping members axially of the inner shaft 46. This illustration is enhanced by reference to FIG. 7 which shows a top plan view of the clipping head with the various gathering and clipping members in the open or "loading" position. This configuration corresponds to that illustrated in FIG. 4.

Figure 7:
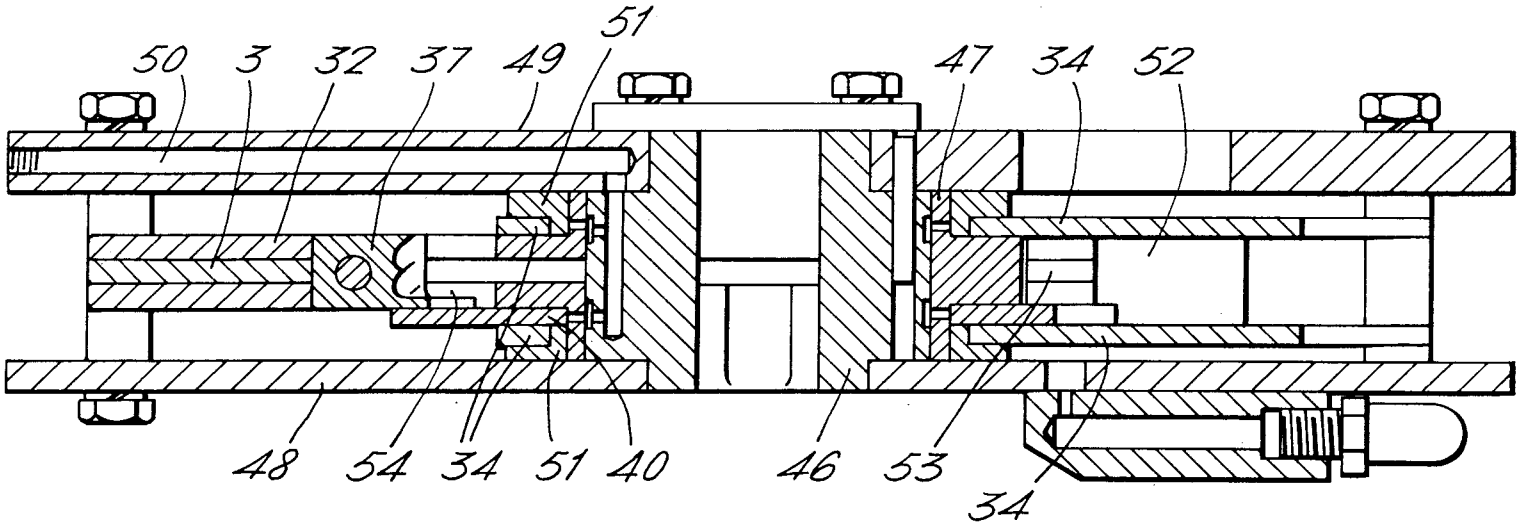
FIG. 7 is a horizontal sectional view taken through the hub of the clipping head of FIGS. 3 to 6 but with the gathering members in open configuration.

FIG. 7 additionally illustrates a lubrication passage 50 to lubricate the bearing surfaces between the inner shaft 46 and the outer bearing sleeve 47 and also between the outer bearing sleeve 47 and outermost spacer sleeves 51 which were omitted from FIG. 6.

Also much more clearly illustrated in FIG. 7 is the spacer block 52 which is carried between and bolted to the righthand gathering plates 34 and includes a portion 53 which serves as the righthand clip guide to co-operate with the lefthand clip guide 54 which forms a part of the clipping die 37 carried by the lefthand gathering member 32.

The construction of each of the gathering members 32 and 34 can best be seen by reference to FIGS. 8 and 9. FIG. 8*a* shows an elevational, partly sectional view of the lefthand gathering member 32 but omitting the clipping die 37.

In order to accomodate various different types and sizes of clip it is advantageous for the clipping die 37 to be removable and replaceable by an alternative part which will have the same external form to engage the socket 60 in the gathering member 32, but will have different shapes of clip-deforming groove. For the purpose of holding the clipping die 37 in position the gathering arm portion 61 of gathering member 32 has a clearance hole 62 to receive an appropriate securing bolt which then screws directly into the clipping die 37.

FIG. 8*b* shows a section taken on the line B—B of FIG. 8*a* and illustrates clearly the clipping slot 63 which, in the closed or clipping position of the various gathering members 32 and 34 allows the clip to be driven radially outwardly into engagement with the clipping die 37 to be carried by the gathering arm portion 61 of member 32.

FIG. 8*c* shows a sectional view taken on the line A—A of FIG. 8*a* and shows clearly that the member 32 has a sleeve portion 64 which will be coaxial with the inner shaft 46 (FIGS. 6 and 7) of the gathering hub and will serve as a journal to support mounting ring portions 65 (FIG. 9*a*) of the two adjacent righthand gathering plates 34.

FIG. 8*d* is further elevational, partly sectional view of the gathering member 32 of FIG. 8*a* but showing the view from the reverse side. The sectioning is deliberately altered in order to illustrate an arcuate cut-away 66 in both the sleeve portion 64 and an adjacent portion 67 of the mounting ring of the member 32 for the purpose of allowing the gathering plates 34 to commence disengagement before complete retraction of the clipping punch 36 (FIGS. 4 to 7).

FIG. 8*d,* along with the FIG. 8*a,* shows a bracket 68 recessed with respect to the remainder of the mounting sleeve 64 and gathering arm portion 61 to serve as an attachment point for the pivot pin 33 for connection to the drive strut 31.

As can be seen from FIGS. 8*a* and 8*b,* the gathering surface 38 of member 32 is not completely flat but is instead machined to a rounded cross section in order to avoid presenting any sharp edges which might cut into the bag neck N during the gathering operation. The same applies to the corresponding gathering surface of the two righthand gathering plates 34.

In FIG. 9*a,* there is shown a front elevational view of one of the two complementary righthand gathering members 34 which each comprise the mounting ring 65 and a gathering arm portion 70 which has a convex gathering surface 71 similar to the gathering surface 33 of the member 32.

The sectional view of FIG. 9*b,* taken on the line A—A of FIG. 9*a,* illustrates clearly the rounded shape of the gathering surface 71 of the arm portion 70 and also a rounded formation on the co-operating gathering part 72 of the mounting ring 65.

It will be seen from FIGS. 8*a* to 8*d* and 9*a* to 9*c* that the various gathering members 32 and 34 have their gathering surfaces 38 and 71, respectively, convex towards the axis of rotation of the hub of the gathering members.

The gathering members 32 and 34 are thus able (*a*) to generate a radially inward movement of the bag towards the axis of rotation of the hub of the gathering head so that the bag is pressed against the oppositely rotating mounting rings 67 and 65 of the members 32 and 34, respectively, while (*b*) the opposing movement of the oppositely rotating gathering members causes the bag neck to be bunched together in the circumferential direction so that the gathering action is now progressively carried out by simultaneous gathering in the vertical and the horizontal directions (when considered in relation to the orientation of the gathering and clipping head 10 in the apparatus 1 of FIG. 1).

The bag neck may have been partially pregathered during manual loading (in the case of large products) but the main gathering action starts just before the gathering surfaces 38 and 71, respectively, commence their overlapping engagement and proceeds until the members 32 and 34 have arrived at their final or clipping position in which the clipping die 37 secured to the gathering member 32 and the spacer block 52 secured between the two gathering plates of the member 34 have come together to define the clipping slot, and the clipping die itself is in line with the two sides of the slot for resisting advance of the clip and for bending over the legs of the clip around the lightly bunched bag neck B.

In this way, by combining the vertical and horizontal gathering action it is possible to achieve two important advantages.

Firstly, the short radial extent of the gathering arm portions 61 and 70 of the members 32 and 34 (as compared with the radial dimensions of the gathering arms of our above-mentioned U.S. Pat. No. 1,361,142) gives a very robust construction which has only a small radius of gyration so that the gathering action, and in particular the opening of the gathering members after clipping, can be carried out much faster and quieter than before. Secondly, this same short radial extent of the gathering arm portions means that the gathering member 32 is particularly rigid in the radial direction thereby enabling the reaction forces to the clipping action to be sustained without the need for heavy reinforcement of the metal gathering arm portion 61 of member 32.

Furthermore, the short radial extend and 'wide-angle' gathering movement means that the opposed gathering members 32 and 34 can in their open configuration readily be retracted completely below the plane of the feed conveyor 4 of FIG. 1 (i.e. below the horizontal plane P—P in FIGS. 4 and 5 which is tangent to the bottom of the cross-section of the gathered neck B) without requiring a very wide chamber, and this allows (a) much greater ease of access of the loaded bag C to the chamber and (b) a smaller chamber volume to be evacuated, and also (c) ensures that the access space is completely uncluttered.

The sectional view of FIG. 9*c*, taken on the dog-leg section line B—B of FIG. 9*a*, shows countersunk holes 73 which serve for securing the righthand gathering plates 34 to their connecting block 52 (FIG. 7) to ensure that they both move in unison and are correctly spaced in a direction axially of the inner shaft 46. Additionally, each plate 34 has a hole 73*a* for receiving a dowel pin to help secure the spacer block 52 in the correct position.

The mounting hole for the pivot pin 33 is shown at 74 in FIG. 9*a* and, because of the much thinner overall form of each individual gathering plate 34, there is now no need for the hole 74 to be cut in a recessed portion of the gathering member 34.

To engage this recessed part of the gathering member 34 and the lefthand drive link plate 27 the lefthand drive strut 31 has forked ends. The righthand drive strut 31 is similarly bifurcated to engage within the plates 34 of the righthand gathering member at one end and around the drive link plate 27 at the other end. The portion of the spacer block 52 which lies between the holes 74 is itself formed as a recessed bracket to receive the bifurcated end of the righthand drive strut 31 so that the pivot pin 33 then passes through both plates 34, both halves of the bifurcated end of strut 31 and also the bracket of block 52.

FIG. 10*a* shows a front elevational view of the cutter 40 as comprising a mounting ring 80 having three radially outwardly extending projections, the first such projection 81 including the cutting blade 82, the second such projection 83 including an abutment face 84 to engage the righthand pivot pin 33 to rotate the cutter in the clockwise direction as viewed in FIG. 10*a*, and the third projection 85 has a further abutment face 86 for engagement with a drive pin 90 (FIG. 11) to rotate the cutter in the anticlockwise direction as viewed in FIG. 10*a*.

FIG. 10*b* is a sectional view taken on the line B—B of FIG. 10*a*.

The abutment surface 84 of projection 83 is, as indicated above, engaged by the pivot pin 33 articulating the righthand gathering member 34 to its drive strut 31, so that during the clockwise retreating movement of the gathering member 34 at the end of a gathering cycle the cutter 40 is retracted to a starting position (FIG. 11) by rotation in the clockwise sense to withdraw the blade 82 (FIG. 2) to a position below the upper edge of the side plates 48 and 49 of the clipping head frame 28.

From this explanation, it will be appreciated that the abutment of the pin 33 with the face 84 occurs only during retraction of the gathering plates 34 whereas advancing movement (i.e. anticlockwise motion) of the righthand gathering plates 34 will leave the blade 82 in its retracted position.

Under these circumstances, advancing of the blade 82 to perform its cutting operation must be carried out by engagement of an additional pin (shown at 90 in FIG. 11) with the abutment surface 86.

FIG. 11 illustrates clearly the drive mechanism for this further pin 90 which engages the abutment surface 86 to rotate the cutter in the anticlockwise direction to carry out its cutting stroke during the commencement of return movement of the yoke 23. This pin 90 is carried at the top of a twin link assembly 91 which is in turn pivotable about the stud 24 on which the cam follower roller 25 is rotatably mounted.

The double link 91 is disposed in front of and behind the drive link plate 27 and has on its reverse side (i.e. the side facing away from the viewer in FIG. 11) a cam follower roller 92 rotatably supported on a pin 93 and engaging within a cam groove 94 formed in the rear side plate 49 of the clipper head frame 28 (see also FIG. 3).

The cam groove 94 has a first oblique wall portion 95 on the lefthand side near its upper end (as viewed in FIG. 11) and a second oblique portion 96 lower down but on the righthand side (again as viewed in FIG. 11). The cutter drive pin 90 is disposed on the upper face (i.e. the side facing the viewer in FIG. 11) of the links 91 so as to avoid fouling the oblique cam surface portion 95 during advance of the yoke in the upward direction.

The sequence of movement of the links 91 during one advancing stroke of the yoke 23 will be as follows. The links 91 will remain in their present vertical orientation until the yoke has advanced sufficiently far for the cam follower roller 92 to strike the first oblique surface portion 95 of the groove 94. At this time the roller 92 will be deflected to the right (as viewed in FIG. 11) by the oblique portion 95 thereby causing the links 91 to pivot in the clockwise sense about the axis of stud 24. Once the roller 92 has cleared the oblique portion 95 and is centrally positioned within the uppermost vertical extension 97 of the slot 94 the links 91 will have arrived at their extreme clockwise position and thereafter the small remaining movement of the yoke 23 upwardly will cause the links 91 to translate in the upward direction but maintaining the same angular orientation to carry the pin 90 above the level of the toe 98 of the cutter 40.

At this stage, the gathering members 32 and 34 will have completed their closing movement and have arrived at the clipping position and, during the latter stages of advance of the yoke 23, the clip will have been driven upwardly by the punch 36 to carry out the clipping action. The yoke 23 then descends to re-open the gathering members but first the cutter 40 has to be rotated in the anticlockwise direction to achieve the cutting action. This is carried out as follows:

As the yoke 23 begins to retract, the link 91 will still be in its extreme clockwise orientation and the pin 90 will therefore engage the toe 98 of the projection 85 of the cutter 40. Thereafter as the yoke 23 descends the pin 90 will descend, intially in a rectilinear vertical direction to pull the abutment surface 86 downwardly causing anticlockwise rotation of the cutter 40 to cause the cutting blade 82 to sweep across the gathered and bunched bag neck B (see FIG. 5) to sever the excess bag material from the bunched bag mouth.

During this initial part of the movement of the yoke 23, (a) the roller 92 will be riding down the righthand wall of the groove 94 and will not yet have struck the righthand oblique surface section 96, (b) the cam follower roller 25 rotatably mounted on the stud 24 will be descending down the rectilinear run **26*a* of the cam slot 26 since it would not yet have arrived at the FIG. 5 configuration, and consequently (c) the gathering members 32 and 34** will still be in their closed or clipping position and will not have commenced separating movement.

Once the cam follower roller 92 strikes the oblique section 96 of the wall of groove 94, the links 91 will pivot in the anticlockwise direction and the pin 90 will then ride off the abutment surface 86 past the toe 98. At about this time the anticlockwise movement of the cutter 40 will be stopped by abutment of the abutment surface 84 of its other projection 83 against the pivot pin 33 which links the two righthand gathering plates 34 with their drive link 31.

The cutting stroke will have been completed and during further movement of the yoke 23 in the downward direction the cam follower roller 25 will eventually pass the junction between runs **26*a* and 26*b* of the cam slot 26 in drive link plate 27 and will cause clockwise pivoting of the lefthand link plate 27 shown in FIG. 11 so that the lefthand drive strut 31 will now have started its descent along with the righthand drive strut 31. At this stage, the already existing abutting engagement between the pivot pin 33 between the righthand drive strut 31 and the righthand gathering plates 34 will immediately cause the cutter 40 to begin clockwise rotation to sweep the cutting blade 82 transversely across the now opening clipping aperture to return the cutter 40 to the retracted position illustrated in FIG. 11. Its arrival in this position is signalled by abutment of the face 86 with a stop pin 99 at the same time as the drive struts 31 have reached their lowermost positions and the pivot pin 33 will stop its clockwise orbiting about the axis of the inner shaft 46.**)

The yoke 23 can be seen in FIG. 11 as including a deep U-shaped recess 102 and a shallow U-shaped recess 103 which both serve to receive the pivot pin 30 between the drive link plate 27 and the drive strut 31.

When the yoke 23 is in its lowermost position, as viewed in FIG. 11, the pivot pin 30 is received in the shallow slot 103 but as soon as the yoke starts to rise the rolling engagement between the roller 25 and the slot 26 of drive link plate 27 causes rapid anticlockwise rotation of the drive link plate 27 with a result that the pivot pin 30 rises faster than the U-shaped recess 103 and also moves leftwardly, i.e. orbits about the axis of rotation of the drive link plate 27, as defined by the axis of the pivot pin 29. Once the drive link plate 27 has reached its extreme anticlockwise position and the cam follower roller 25 is ascending the vertical, rectilinear run **26*a* of the slot 26 the pivot pin 30 will be stationary above but directly in line with the recess 102 in the yoke 23 so that, as the yoke rises, the recess straddles the pivot pin 30. A similar arrangement will be present on the righthand side of the yoke underneath the pivot pin 30 between the righthand drive strut 31 and the righthand drive link plate 27.**

In order to enable accurate positioning of the pivot axis of each of the drive link plates 27 (FIG. 11) the pivot pin 29 is eccentrically formed on a rotatable adjustor 200 which can be turned by means of a flatted head 201 to allow the position of the eccentric pivot pin 29 to be changed. This will provide for accurate positioning of the axis of pivot pin 24 in a direction parallel to the direction of yoke travel so as (a) to enable the rest of the pin 90 joining the links 91 to be adjusted for ensuring that the pin clears the toe of the cutter, and (b) to enable the width of the clip guide slot remaining between the opposed gathering members 32 and 34 to be adjusted accurately.

FIGS. **12*a* and 12*b* illustrate an alternative embodiment of the cutter, here referenced 140. In this form, the apparatus is viewed from behind so that those parts which had previously been referred to as the lefthand parts of the machine now appear on the righthand side of FIG. 12*a*.**

Thus the righthand pivot pin 33 (the pin linking the gathering member 34 and the associated drive strut on the lefthand side of FIG. **12*a*) is able to move in a slot 141 of the cutter 140 to effect the retraction of the cutter to the FIG. 12*a*** position.

The pin 190 now engages a much longer abutment surface 186 of the cutter 140 and is supported between two links 191 (see also FIG. **12*b*), again driven from the stud 24 which supports the cam follower roller 25 on the yoke 23. However, in this form the cam follower roller 92 rides up a single dog-leg cam wall 142 so that initially the pin 190 rides along an arcuate radially outer surface 143 of the cutter 140 while the cam follower roller 92 rides up the substantially vertically extending run 142***a* of the cam surface 142.

Once the cam follower roller 92 arrives at the top of the run 142*a* of cam surface 142 it becomes deflected leftwardly and radially inwardly towards the centre of rotation of the cutter 140 and this causes the pin 190 to move rapidly leftwardly across the toe 144 of the cutter 140 to engage behind the abutment surface 186.

When the yoke 23 next descends, the pin 190 will be trapped by the toe 144 of the cutter 140 and thus the cutter will be driven for clockwise movement (as viewed in FIG. 12*a* ) during the initial part of the descent of the yoke until the inclination of the cutter 140 is such that the pin 190 can slide off the end of the cam surface 186 past the toe 144 of cutter 140 to release the cutter. At this time the clockwise rotation of the cutter will have resulted in the lowermost end 141*a* of slot 141 arriving in abutment with the pin 33 which will still be in its FIG. 12*a* position.

Further descent of the yoke 23 will drive the pivot 33 for rotation in the anticlockwise sense, as viewed in FIG. 12*a,* and this will retract the cutter to the FIG. 12*a* position.

FIG. 12*b* shows a side elevational view of the mechanism of FIG. 12*a* and illustrates clearly the two links 191, one at the front of the clipping head and one at the back of the clipping head, interconnected by the pin 190 which then engages the cutter 140 near one end of the pin 190.

FIGS 13 to 15 illustrate the operation of one form of clip feed unit for use with the apparatus of FIGS. 1 to 12.

In this embodiment of feed unit, piston 160 driven by a piston rod 161 from a pneumatic jack 162 progressively advances leftwardly to drive the line 41 of clips 42 towards the clipping plane, i.e. the plane of the clipping punch 36. This clipping plane is defined by a reaction piston 163 which is hollow and has a weak compression spring 164 within it. At its lefthand end, the reaction piston 163 has a flange 165 which serves for signalling purposes as will be described later.

When the line 41 of clips 42 in the clip chamber 166 has been exhausted, the flange 165 of reaction piston 163 lifts off the lefthand end wall of the cylinder 176 enclosing the reaction piston to signal a depleted clip supply and this causes actuation of the jack 162 to reteact the piston rod 161 and piston 160 in the rightward direction until the piston 160 is completely withdrawn out of the clip chamber 166 of a rotary clip magazine 167 and instead into the clipper jack housing 168. This will leave the clip magazine 167 free for rotation about its central shaft 169 and this rotation is effected by operation of a bellcrank 170 as follows:

As the piston 160 retreats into the clipper jack housing 168 it strikes the upper end 171 of a generally vertically extending limb of a bellcrank 170 and causes it to move rightwardly, with the result that the bellcrank pivots about its pivot shaft 172 to cause a pawl 173 at the end of a generally horizontally extending arm 174 of the bellcrank to rise and thereby to index the magazine by engagement with a toothed ring 175 on the end of the clip magazine 167. The angular movement of the bellcrank 170 is just sufficient to index the magazine by one step to bring the next, presumably full, clip chamber 166 into line with the drive piston 160.

FIG. 14 shows a transverse sectional view through the clip magazine and shows the various clip chambers equiangularly spaced around the axis of the magazine and its supporting shaft 169.

After indexing the magazine the jack 162 is then actuated for movement in the advancing sense to drive the piston 160 forward, i.e. leftwardly, into engagement with the line of clips in the fresh clip chamber and to push the line of clips leftwardly so that the leading clip 42 abuts the reaction piston 163 and drives the reaction piston back against the end of its containing cylinder 176. At this point the piston 163 is immovable and provides a reaction face in line with the clipping plane so that the end clip 44 is correctly positioned for striking by the clipping punch 36 in its next upward stroke.

FIGS. 15*a,* 15*b* and 15*c* illustrate in greater detail the operation of the clip drive system.

As can be seen from FIG. 15*c,* the clip drive piston 160 is a hollow cylinder enclosing an internal piston 177 which is spring biased away from the righthand end wall 178 of the cylinder by means of a helical compression spring 179. An external collar 180 of diameter larger than the internal diameter of the cylinder forming the clip drive piston 160 is positioned further along the piston rod 161 outside the piston.

This external collar 180 slides in a bore 181 which is smaller than the external surface of the clip drive piston 160 but is larger than the internal diameter of the cylinder forming the drive piston 160 so as to accommodate the external collar 180 slidably therewithin.

A shoulder (FIG. 15*c*) dividing the relatively narrower bore 181 from the wider bore 182 which receives the clip drive piston 160 defines an end stop which prevents the piston 160 from retracting beyond its position of being just outside the clip magazine 167. This limit is necessary in order to use the piston 160 as a plug to close off the bore 182 flush with the surrounding face 183 of the clipper jack housing to prevent the clips which will be loosely positioned in the rotary magazine 167 from moving axially out of the clip chamber 166 and jamming in the mouth of the bore 182 during the magazine indexing rotation.

The action of the compression spring 179 means that normally the internal piston 177 is at the extreme lefthand end of the cylinder forming the clip drive piston 160 and this configuration is clearly illustrated in FIGS. 15*a* and 15*b.* The spring 179 only becomes compressed once the clip drive piston 160 has been retracted clear of the clip magazine 167.

Referring now to FIG. 15*a,* there can be seen a normal clip drive configuration in which the piston rod 161 urges the piston 160 leftwardly into engagement with the line 41 of clips 42 approaching the clipping head. This holds the end clip 44 against the face of the reaction piston 163. As a consequence, the flange 165 of the reaction piston 163 is against the extreme lefthand wall of the enclosing cylinder 176 and this generates a "clip present" signal at a line 183, in this case an air conduit, communicating with the end wall of the cylinder 176.

Once the supply 41 of clips is exhausted, as at 15*b,* the piston rod 167 will be in its extreme lefthand position just flush with the righthand edge of the clipping slot. At this point, there would normally be a gap between the clip drive piston 160 and the reaction piston 163 but this gap is taken up by the action of the compression spring 164 within the piston 163 to cause the piston 163 to move rightwardly by approximately the thickness of one clip and this now releases the flange 165 from the end wall of the enclosing cylinder 176 to signal a "clip supply exhausted" signal by any suitable means such as a pneumatic signal transmission system. The result of this signal is to reverse the jack 162 to withdraw the piston 160 the full length of the clip chamber 166 of the magazine 167 until it arrives at the FIG. 15*c* position where the piston 160 will be completely outside the magazine 167 but will be constrained against further rightward movement by virtue of the shoulder between the relatively narrower and wider diameter bore portions 181 and 182, respectively, in the clip drive housing.

At this point, the piston will be held while the piston rod 161 retracts still further so that the part of piston 180 carried on the piston rod 161 strikes the toe 171 of the bellcrank 170 to index the clip magazine 167 by one step to bring a further fresh clip chamber 166 into line with the clip drive piston 160.

On exhaustion of the total supply of clips in the magazine 167, the next advancing stroke in the leftward direction of the piston 160 after an indexing operation will fail to remove the "clip supply deleted" signal on the line 183 and as a result the operator of the machine will become aware of the fact that the magazine 167 must be reloaded. This reloading operation can be relatively simply carried out by raising that part of the product feed roller conveyor 4 inside the chamber 2 to gain access to the top of the clip drive mechanism 11, and then opening the clipper drive top cover 184 to expose the top clip chamber 166. This chamber 166 can then be loaded, and the magazine 167 indexed manually to allow each of the chambers 166 to be loaded successively until all chambers are full.

Alternatively the entire magazine 167 may be designed to be removable to allow substitution of a new magazine for the depleted magazine.

A counter may be provided to record the number of magazine indexing steps since fitting the magazine 167, thereby indicating the number of chambers 166 used so far.

With the particularly convenient clip feed mechanism illustrated in FIGS. 13 to 15, there is a simple clip drive mechanism which is virtually jam-free and is nevertheless capable of being rendered safe in the most unlikely event of a clip jam. A jam of the clip line 41 either along the clip chamber of the magazine 167 or through the centre of the hub of the clipping head will mean that once the leading end clip 44 has been driven upwardly around a bag there will be no advancing of the line of clips to bring a fresh clip into line with the clipping slot and as a consequence the reaction piston 163 will move rightwardly to generate a clip supply depleted signal on the pneumatic line 183. This will (a) generate a signal for the operator, (b) render the machine inoperative until the signal has been removed, and also (c) trigger retraction of the piston 160 prior to removal of the magazine to investigate the fault.

If the same clip supply signal depleted signal arises at any time during normal operation of the machine and merely because of depletion of a particular line 41 of clips 42, then machine automatically indexes the magazine to provide a full clip chamber in register with the piston 160.

The lost motion linkage between the piston rod 161 and the clip drive piston 160 (illustrated in FIG. 15*c*) has the advantage that even though the clip magazine indexing movement will not start until the clip drive piston 160 has been retracted completely clear of the magazine and against the shoulder between the relatively narrower and relatively wider bore portions 181 and 182, respectively, the drive piston 160 will not retract further during this indexing operation and will thus not expose the bore 182 to the clip supply 41 in the next chamber 166. Once the piston 160 has retracted thus far the strong compression spring 179 will allow itself to be compressed to permit further retracting movement of the piston rod 161 to effect indexing of the magazine by engagement of the piston 180 with the toe 171 of the arm of the bellcrank 170.

If desired, the mechanism for preventing escape of the clips from within the clip chambers 166 of the magazine 167 may be simplified considerably by eliminating the lost motion connection between the clip drive piston 160 and the piston rod 161 and instead modifying the cross-sectional shape of both the bore 182 and the clip drive piston 160 slidably received therein in its retracted position.

For example if, as shown in FIG. 17, the clip drive piston 160' and bore 182' are provided with a flat cross section which is at the top so that the piston 160' does not engage the clips 42 at the free ends of the clip legs, then it will, of course, be impossible for the clips 42 in the next full clip chamber to jam between the clip chamber 166 of the magazine 167 and the bore 182 of the clip jack housing 168 since the end clip nearest the clipper jack housing 168 would at all times have the free end of its legs in contact with a portion of the surface 183 of the end wall of the clipper drive housing 168.

In this way there would no need for the clip drive piston 160 to be arrested flush with the end of the bore 182 and, instead, the lost-motion connection shown in FIG. 15*c*, between the clip drive piston 160 and the piston rod 161 could be omitted and the piston could retract further along the bore 182 to strike the toe 171 of the bellcrank arm 170 to generate the magazine indexing rotation.

A further modification of the apparatus is illustrated in FIG. 16 and involves replacing the spring-loaded reaction piston 163 by an arm 190 pivoted at 191 and spring biased by means of a leaf tension spring 192 for movement in the clockwise direction (as viewed in FIG. 16) to cause a vertically extending reaction face 193 at the upper end of the lever to be urged rightwardly into a position of engagement with the next clip (not shown) to be engaged by the punch 36.

FIG. 16 shows the arm 190 in its operating position (corresponding to the FIG. 15*a* position). This position of the arm 190 is defined by a stop 194 which is engaged by an abutment face 195 at the top of the lever. Movement of the reaction face 193 of the lever 190 rightwards is possible, as shown in FIG. 16, although this movement is resiliently resisted by means of the leaf spring 192 until the reaction face abuts a clip guide 196 secured to the clipper head hub by means of a screw 196. This guide 196 defines a U-cross-section block which sits between the two legs of the clips to guide the line 41 of clips 42 cleanly along the last part of the clip path towards the reaction face 193 of the arm 190.

It will be appreciated that in this embodiment the clip drive piston 160 will be unable to advance right up to the clip punch slot without itself being cut away to fit around this guide 196.

The pneumatic sensor used in this particular form of the apparatus is in the form of a seating 197 which is carried by a bracket 198 and adapted to be closed when the arm 190 is in its extreme anti-clockwise position as defined by abutment of the abutment face 195 against the stop 194.

In fact, the arm 190 is, of course, built up from separate components, namely an L-shaped main arm member 199 and a bifurcated mounting portion 200 carrying the pivots 191 and is secured to the L-shaped main arm member 199 by means of a spacer plate 201 and two bolts 202.

The leaf spring 192 may be replaced by a tension spring which extends between the bracket 198 supporting the pneumatic sensor seating 197, and the bottom of the main arm member 199.

With all the clip drive mechanisms described above, it is envisaged that the magazine will be equipped with a 'click-stop' mechanism in the form of a spring detent to hold the magazine 167 in one position of register between one clip chamber 166 and the hub of the gathering arms until th detent is overpowered by the indexing action of the bellcrank and pawl.

It is envisaged that the rotary magazine 167 illustrated in FIGS. 13 and 14 could, if desired be replaced by a linear magazine in which the various lines 41 of clips 42 could be placed side-by-side on a tray and the tray could be driven laterally after depletion of one clip line and in order to bring a further, full clip line into engagement with the clip drive piston 160.

There is no need to describe a full operating cycle of the machine 1 since this will be evident from the description above. However, it should be noted that removal and substitution of the clipping die 37 to accommodate a different clip size or type requires merely unscrewing of the securing bolt 39 (FIG. 7).

In summary, the above described embodiment of clipping head has the following advantages:

By feeding the clips to the clipping station along the pivot axis of the gathering arms, it is possible to use shorter gathering arms than those used hitherto. This is advantageous since the stresses on the gathering arms during clip deformation are reduced and, because the "play" at their pivot points is less amplified at the ends of the gathering arms, the accuracy of the movement of the gathering arms is increased. Furthermore, the gathering arms can easily be retracted below the horizontal level at which clipping takes place and this permits a compact construction of clipping head and enables a standard head to be provided which can accommodate almost any product width. Feeding the clips to the clipping station along the axis of pivot to the gathering arms also enables the clipping head to be more compact in its vertical dimension than prior art heads and enables the air cylinder to be positioned outside the vacuum chamber. These features enable the chamber volume to be reduced, permitting shorter vacuumising times and thus operation at higher speed.

The mechanical linkage between the gathering arms and clip drive piston and also between the knife or cutter and clip punch ensures good synchronisation of the movements of these components and hence permits high safe working speeds.

The eccentrically mounted pivot pins 29 allow for accurate adjustment of the position of the gathering arms relative to the punch.

The provision of the reaction piston 163 provides a particularly simple and effective means for actuating rotation of the clip magazine when one row of clips is exhausted and of stopping the operation of the clipping head when either all clips are exhausted or a clip jam occurs. Since the reaction piston blocks off the clipping punch guide space when no clips are present, when fresh clips are urged towards the plane of the clipping punch 36 by the clip drive piston 160, they are prevented from falling down the clipping punch guide space. Furthermore, if the pressure on the clip drive piston 160 is released, the reaction piston is able to push the row of clips back along the magazine, thus making it possible to operate the clipping head without clips if this is required for maintenance purposes. This action also facilitates the removal of remaining clips from the magazine so that they may be interchanged for a different type of clip.

This clip magazine assembly is designed to feed clips in a horizontal direction, which makes it much more suitable for use in a chamber vacuumising machine than, for example, is a gravity clip feeding arrangement.

We claim:

1. A gathering and clipping head for closing bags or the like comprising:

a. opposed gathering members, b. a common hub rotatably supporting said gathering members, c. arcuate gathering surfaces formed on said gathering members and arranged to be convex towards said common hub and to overlap in the closed configuration of the gathering members to gather together the neck of a bag to define a tightly gathered neck configuration for clipping, d. a clip guide slot defined by said gathering members when in their closed positions;

e. a clip-leg deforming die carried by one of said gathering members, f. means for axially guiding a supply of clips to a location within said hub, and g. means for driving individual clips radially outwardly from the said location within the hub to be deformed around a bag neck gathered by said gathering members.

2. A gathering and clipping head as set forth in claim 1, and including cutter means rotatably mounted coaxially with respect to said hub and means for driving said cutter means to rotate to sever surplus bag material from the clipped neck, as the clipping punch begins to retract and before the gathering members open to release the clipped neck of the bag.

3. A gathering and clipping head as set forth in claim 2, and including a common reciprocating drive member for driving the cutter means, the clipping punch and the gathering members such that during retraction of the clipping punch the cutter means is driven to rotate in a first direction to cut the gathered bag neck, and subsequently in the reverse direction to return to its starting position in which it is retracted below the tangent plane to the bottom of the position occupied by the cross-sectional of a bag neck when gathered by the gathering members.

4. A gathering and clipping head as set forth in claim 3, wherein the gathering members are driven to open apart from their closed position during later retracting movement of the clipping punch.

5. A gathering and clipping head as set forth in claim 4 and including a pneumatic ram having a piston connected to said common reciprocating drive member.

6. A gathering and clipping head as set forth in claim 1, wherein said means for guiding a supply of clips includes:- a rotary magazine having an axis of rotation and a plurality of clip-receiving chambers disposed equiangularly around said axis of rotation; a common clip drive piston, means for driving said drive piston through one of said clip chambers to urge clips in said chamber through the chamber; and means responsive to depletion of a supply of clips in said one of the chambers for retracting said drive piston from the magazine and for automatically indexing the magazine to bring a different chamber into register with said drive piston.

7. A gathering and clipping head as set forth in claim 1, wherein said arcuate gathering faces are shaped so that said gathering members carry out their gathering action during substantially the last 60° of rotation of each member towards its closed configuration.

8. A gathering and clipping head as set forth in claim 7, wherein the fully open position of each gathering member is substantially 90° displaced from the fully closed position.

9. A clipping unit for use with vacuum packaging apparatus, comprising a rotary magazine having an axis of rotation and a plurality of clip-receiving chambers disposed equiangularly around said axis of rotation; a common clip drive piston; means for driving said clip drive piston through one of said clip chambers to urge clips in said chamber through the chamber; and means responsive to depletion of a supply of clips in said one of the chambers for retracting said clip drive piston from the magazine and for automatically indexing the magazine to bring a different clip-receiving chamber into register with said clip drive piston, a clipping die spaced from said magazine, and a clipping punch positioned and drivable to urge a clip laterally from one end of said one of the chambers and towards said clipping die.

10. A clipping unit as set forth in claim 9, wherein said means responsive to the depletion of the supply of clips in said one of the chambers comprises:- a sensing member effective to sense the presence of a clip in the path of said clipping punch prior to actuation of the clipping punch, means connecting said sensing member to said means for driving the clip drive piston, and effective to actuate retraction of the clip drive piston from the magazine, and also to index the magazine automatically to bring said different clip-receiving chamber into register with said drive piston and sensing member.

11. A clipping unit as set forth in claim 10, wherein said means for indexing the magazine comprise a ratchet face on said magazine, a pawl engaging in said ratchet face, and a bellcrank having one arm carrying said pawl and another arm positioned to be engaged by said clip drive piston upon retraction of said clip drive piston from the magazine chamber whereby once the piston has retracted fully from the magazine chamber it will retract further and will drive the pawl to index the magazine by an angular increment representing substitution of one chamber by the next successive one of said chambers.

12. A clipping unit as set forth in claim 11, wherein the clip drive piston is hollow and has a piston rod; wherein a subsidiary drive piston is slidably engageable within said hollow piston, said subsidiary drive piston being fixed to the piston rod of said clip drive piston; and wherein an additional abutment collar is carried by said piston rod externally of the clip drive piston in a position where it can abut said other arm of the bellcrank; whereby advancing movement of said piston rod causes said subsidiary drive piston to abut said clip drive piston for driving the clip drive piston along the magazine chamber towards the path of the clipping punch, and retracting movement of said piston rod withdraws the clip drive piston just clear of the magazine chamber where after resiliently resisted further retracting movement of the clip drive piston rod causes said abutment collar to engage said other arm of the bellcrank.

* * * * *